United States Patent [19]

Hermelin

[11] Patent Number: 4,512,571

[45] Date of Patent: Apr. 23, 1985

[54] FORCE OPPOSITION TYPE EXERCISER

[76] Inventor: Victor M. Hermelin, 13547 Ladue Farm Rd., St. Louis, Mo. 63141

[21] Appl. No.: 429,688

[22] Filed: Sep. 30, 1982

[51] Int. Cl.[3] ..... A63B 21/00

[52] U.S. Cl. ..... 272/126; 272/134; 272/70

[58] Field of Search ..... 272/134, 126, 93, 138, 272/143, 127, 116, 125, 97, 70

[56] References Cited

U.S. PATENT DOCUMENTS

| | | | |
|---|---|---|---|
| 232,022 | 9/1880 | Gifford et al. | 272/134 X |
| 430,808 | 6/1890 | Naish | 272/126 |
| 2,472,391 | 6/1949 | Albizu | 272/134 X |
| 2,614,609 | 10/1952 | Denison | 272/70 |
| 2,772,881 | 12/1956 | Fundom | 272/126 |
| 4,101,124 | 7/1978 | Mahnke | 272/134 |

FOREIGN PATENT DOCUMENTS

| | | | |
|---|---|---|---|
| 2631897 | 1/1978 | Fed. Rep. of Germany | 272/97 |
| 200296 | 3/1938 | Switzerland | 272/134 |

OTHER PUBLICATIONS

"Cross-Country Shortcut", Article in Washington Star, p. 23, Mar. 30, 1980.

*Primary Examiner*—Richard J. Apley
*Assistant Examiner*—William R. Browne
*Attorney, Agent, or Firm*—Polster, Polster and Lucchesi

[57] ABSTRACT

An exercise machine in which four interconnected movable stations are provided, two hand and two foot, one hand and one foot station being connected by a cable by way of pulleys for moving the stations in opposite directions in response to the exertion by the user of a preponderant force upon one of the stations, the other hand and foot station being connected by another cable by way of pulleys for moving the stations in opposite directions in response to the exertion by the user of a preponderant force upon one of the stations, and the two foot stations being connected to one another for moving the foot stations in opposite directions in response to the exertion by the user of a preponderant force upon one of the foot stations.

5 Claims, 10 Drawing Figures

FIG. 1.
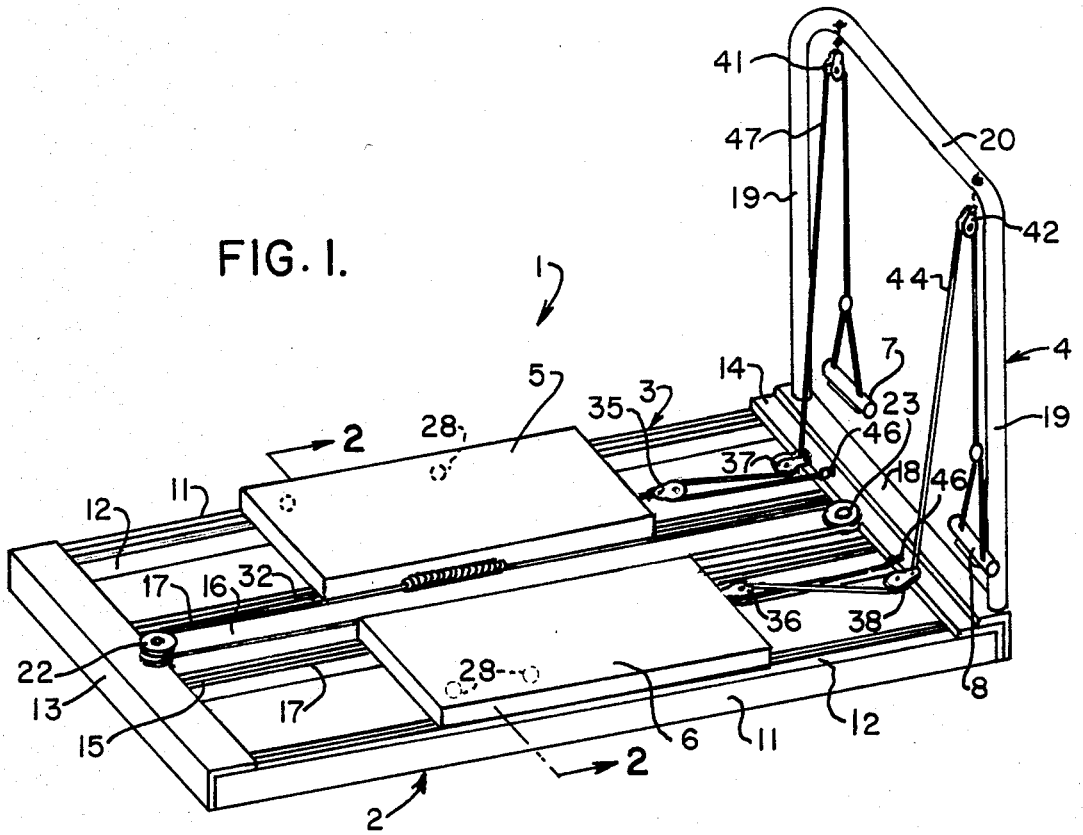
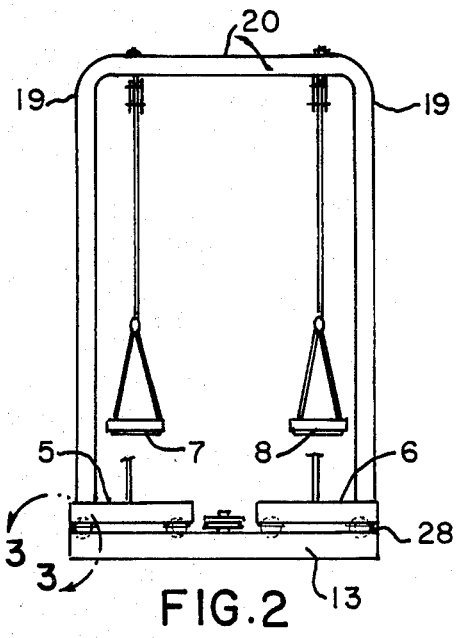
FIG. 2
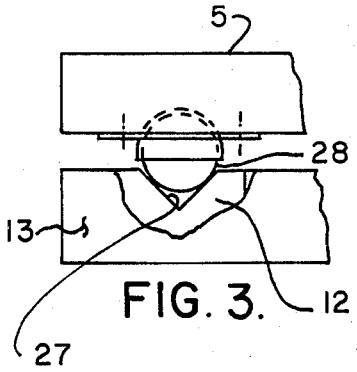
FIG. 3.

FORCE OPPOSITION TYPE EXERCISER

BACKGROUND OF THE INVENTION

There is a widespread awareness of the need to exercise the human body rhythmically, for long enough periods of time, frequently, and strenuously enough to increase respiration and pulse rate so that the cardiovascular and respiratory systems are stimulated, toned, strenghthened and kept active and healthy. Iso-kinetic exercise which also tones and strengthens the peripheral muscle systems, subjects joints to many repeated movements, and structurally loads skeletal bones to keep them elastic and chemically stimulated so they do not deteriorate because of lack of demand, is ideal for these purposes.

Swimming, cycling, calisthenics and jogging are the most widespread forms of iso-kinetic activity. All exercise the cardiovascular system. Each, however, has limitations. In swimming, the midrif is not fully exercised because twisting and bending are minimized. Since we swim suspended in water, essentially free of gravity, bone structures are not stressed and tendons are not conditioned to withstand sudden strains. Cycling has the same limitations, and the additional limitation of almost no upper body exercise. Well designed calisthenic routines, such as aerobic dance if done non-stop and for sufficient time can work out the entire body very effectively. However, since they are not done against resistance, they do not increase strength to the extent that may be desirable. Jogging is simply a calisthenic essentially challenging the legs alone. It has the dangerous limitation of putting jarring strains on the foot, ankle, knee and hip structures.

There are stationary bikes in widespread use. There are good treadmills which permit very natural running. There are many other kinds of exercising equipment available using weights, springs, motors, clutches, etc., for resistance exercising, but these do not encourage continuous, prolonged, repititious, rhythmic movements of the aerobic, iso-kinetic, cardiovascular respiratory system conditioning kind.

There have been many machines or arrangements of pulleys by which arms and legs have been linked to pull against one another. Clease, U.S. Pat. No. 821,783 is an early example, and Gehri, No. 2,716,027, Fundom, No. 2,772,881, Macabet, No. 3,752,474, Codina, No. 3,979,114, Kupperman, No. 3,999,752, Flannery, No. 4,084,815, and Hayes, No. 4,248,420, others. In all of these patented devices, the pull exerted by one member is transmitted to only one other member, or as in Hayes and Macabet, to two tied members. None provides coordinated resistance of each individual member, with natural movement in opposite directions of each left and each right pair.

The machine of this invention can maximally load the cardiovascular and repiratory systems by providing interconnected coordinated movement of all four limbs at the same time, each providing resistance against which they all move individually. It permits many repitions, continuously and rhythmically, including bending, stretching, twisting, balance and coordination of movements.

One of the objects of this invention is to provide a machine by which one can exercise the body iso-kinetically with self imposed resistance, increasing as the body strenghthens.

Another object is to provide such a machine which is simple, rugged, dependable, and economical.

Other objects will become apparent to those skilled in the art in the light of the following description and accompanying drawing.

SUMMARY OF THE INVENTION

In accordance with this invention, generally stated, an exercise machine is provide in which stations for the four members, arms and legs, are interconnected by cables in such a way that when one station is moved, all are forced to move at the same time, individually. If a member is in place at each of the stations, all of the members are forced to move against the resistance of the others, the right arm and leg stations in opposite directions from one another and the left arm and leg stations in opposite directions from one another and from the right arm and leg stations. This is accomplished by interconnecting four stations, one for each member, with cables running through pulleys from the hand (arm) stations to the foot (leg) stations, and interconnecting the foot stations in such a way as to compel them to move in opposite directions if force is applied to one. In the preferred embodiment, the foot stations are connected by a belt tending around pulleys at two ends of a base. The right hand station is connected, by a flexible but substantially inelastic cable, tending about a pulley elevated with respect to the foot stations, to the right foot station, where the cable tends about another pulley connected to the right foot station, and is fastened at its free end to a fixed frame, whereby the travel of the hand station is double that of the travel of the foot station. The left hand station is similarly connected, by a flexible but substantially inelastic cable, tending about a pulley elevated with respect to the foot stations, to the left foot station, where the cable tends about a pulley connected to the left foot station, and is fastened at its end to the fixed base.

BRIEF DESCRIPTION OF THE DRAWINGS

In the drawing,

FIG. 1 is a view in perspective of one embodiment of exercise machine of this invention;

FIG. 2 is a view in end elevation, viewed from left to right of FIG. 1;

FIG. 3 is a fragmentary view in end elevation, partly broken away and somewhat enlarged, of a foot station, race channel and roller from the area indicated by the line 3—3 of FIG. 2.

DESCRIPTION OF THE PREFERRED EMBODIMENT

Figure 4:
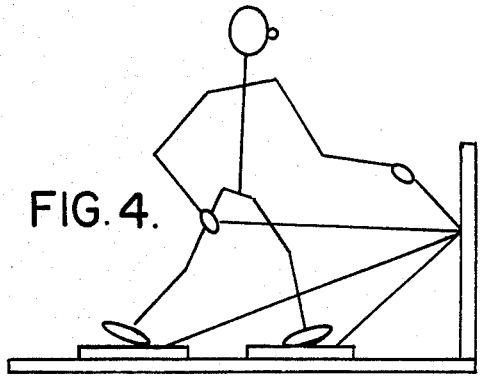
FIGS. 4 through 10 are stick figure drawings illustrating the various uses to which the exercise machine can be put.
Figure 5:
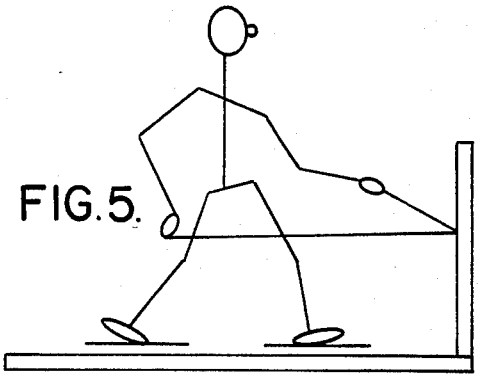
Figure 6:
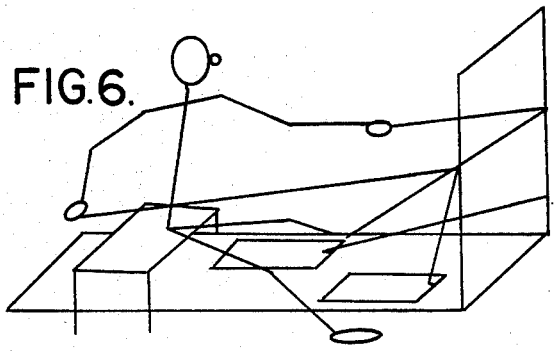
Figure 7:
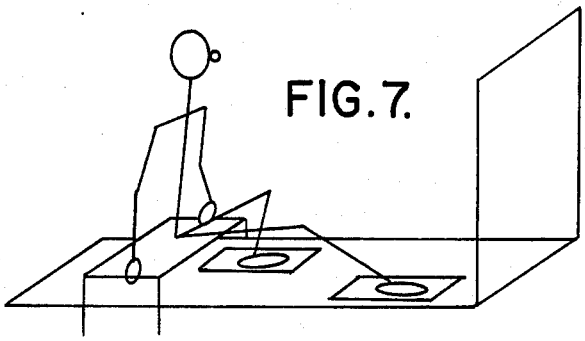
Figure 8:
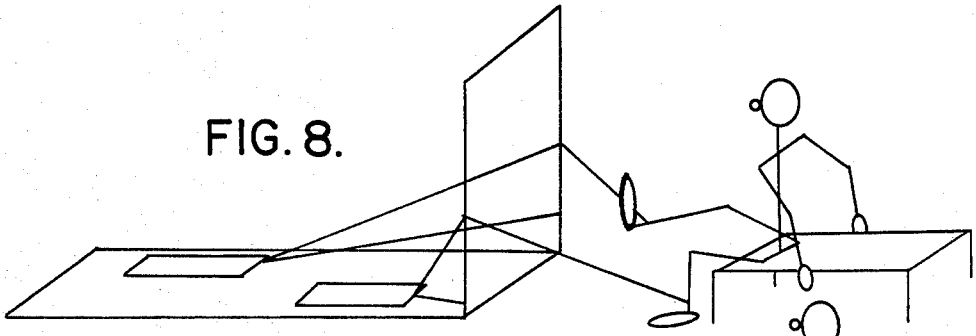
Figure 9:
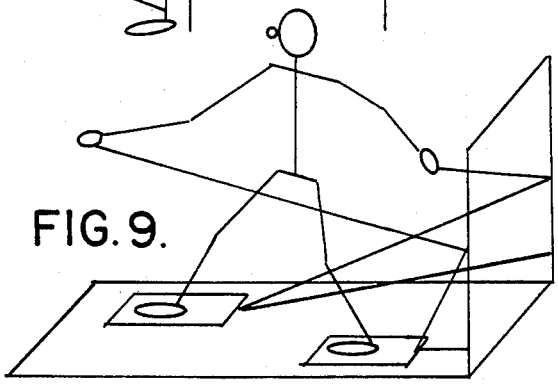
Figure 10:
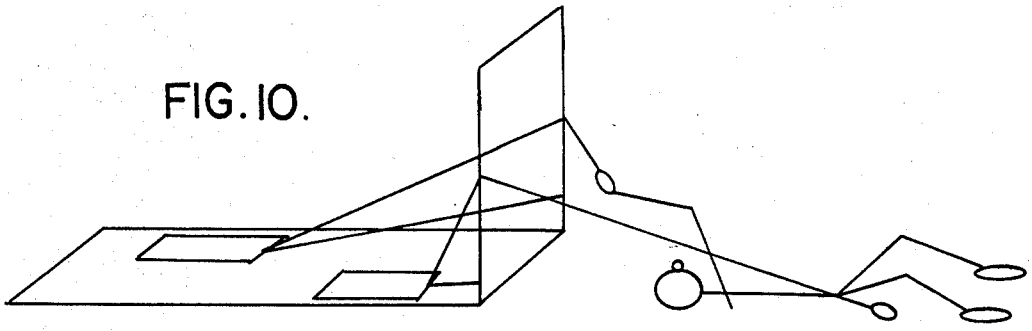

Referring now to the drawing, and particularly to FIGS. 1–3, for one illustrative embodiment of exercise machine of this invention, reference numeral 1 indicates a complete machine. The machine 1 includes a frame 2, made up of a bed 3 and an upright 4, a left foot station in the form of treadle 5, a right foot station in the form of treadle 6, a left hand station in the form of hand grip 7, and a right hand station in the form of hand grip 8.

The bed has side rails 11, side runners 12, an outer end rail 13, an upright end rail 14, and center rails 15 and 16 with center runners 17. The upright 4 has a base 18, connected as by welding, bolting or riveting, to the bed rail 14, legs 19 secured to the base 18, and a cross bar 20, in this embodiment integral with the legs 19.

The side and center rail runners, in this embodiment, are provided with race channels 27, in which rollers 28, mounted on the underside of the treadles, roll to permit longitudinal movement of the treadles with little friction.

An outer sheave 22 is mounted on a vertical axis on the outer end rail 13, and an upright end sheave 23 is mounted on a vertical axis on the upright end rail 14. An endless belt 32, extending around the two sheaves 22 and 23, is connected midway of its two long reaches when the treadles are side by side, to the treadles. The belt can be of any well known type, e.g. reinforced rubber, V, fiber, plastic, or metal. In the latter case, it can take the form of chain such as bicycle chain, in which case the sheaves can take the form of sprockets. By virtue of this arrangement, when one of the treadles moves toward the upright, the other moves away from the upright, and vice versa.

On the upright side of the treadles, a left treadle pulley 35 is swivelly connected to the left treadle 5, and a right treadle pulley 36 is swivelly connected to the right treadle 6. A left upright end rail pulley 37 is swivelly mounted on the upright end rail 14 in substantial longitudinal alignment with the left treadle pulley 35. A right upright end rail pulley 38 is swivelly mounted on the upright end rail 14 in substantial longitudinal alignment with the right treadle pulley 36.

A left upright pulley 41 is swivelly mounted on the cross bar 20 near the left leg of the upright, in substantially the same vertical plane as the left end rail pulley 37, and a right upright pulley 42 is swivelly mounted on the cross bar 20 near the right leg of the upright, similarly above the right end rail pulley 38.

A right cable 44 is connected to the right hand grip 8, extends through the block and around the sheave of the right upright pulley 42, through the right upright rail pulley 38, around the sheave of the right treadle pulley 36, and is fastened at its free end to a cable end anchor 46 on the end rail 14. A left cable 47 is connected to the left hand grip 7, extends through the block and around the sheave of the left upright pulley 41, through the left upright end rail pulley 37, around the sheave of the left treadle pulley 35, and is fastened at its free end to a cable end anchor 46 on the end rail 14. The term "cable" is used to encompass any suitable flexible member that is substantially inelastic in the lengthwise direction, such as a cotton or other fiber line or rope, plastic cord, such as nylon, polypropylene, polyethylene or the like, or even metal.

It can be seen that with this arrangement, the force exerted when a hand grip is pulled back is doubled on the corresponding treadle and the travel of the foot station is only half that of the hand grip. This accords with normal relative strength and degree of movement of those members. When a hand grip is pulled back, its corresponding treadle moves forward, causing its motion to be transmitted through the belt 32 to move the other treadle backward and its corresponding hand grip to move forward. If, by virtue of force exerted by the user's leg, a treadle is moved backward, the corresponding hand grip is moved forward, and the other treadle and handgrip are moved in the opposite directions.

The arrangement of this machine provides great versatility. If it is desired to exercise only the arms, they can be used to pull against one another without any alteration of the machine or the cable, because force applied to one hand grip is transmitted, by way of the treadle belt, to the other. Similarly, if the legs are to be exercised without the arms, the belt 32 will transmit force from one leg against the other, regardless of the fact that the hand grips are hanging loose. Three members can be exercised, for the same reasons. A few of the many ways in which the device can be used are illustrated in FIGS. 4 through 10. The legs can be exercised without applying the stress on the joints that would be produced by standing on the treadles, by sitting on a bench and putting the feet on the treadles as in FIG. 7 or sitting and putting the feet in the hand grips, as in FIG. 8, or by lying down and putting the feet in the hand grips. One leg and one arm can be exercised by putting a foot in one hand grip, a hand in the other, to provide an unusual coordinative exercise. Other specialized arrangements utilizing the machine can be used for special physical therapy exercises patterned to the disability of specific patients.

If it is desired, the right cable can be made to tend from the right upright pulley to the left upright end rail pulley, and the left cable, to the right upright end rail pulley, so that pulling on a hand grip will cause the treadle of the opposite leg to move back and the corresponding leg to move forward. The important part is that each member is moved individually, so that one can exert the desired resistance with any and all of the members, from a standing or sitting position, and that one can use any two or three members against one another as well, if that is desired.

Merely by way of illustration, the frame bed can be rectangular, 5' by 18", and the upright, 3' tall. The treadles can be 8" wide, and 18" long. The balls or plastic wheels, as the case may be, on which the treadles roll, can be $1\frac{5}{8}$" in diameter, and the side and center rails 2" deep to provide a guide wall for the treadles along the length of the frame.

Numerous variations in the construction of the device of this invention, within the scope of the appended claims, will occur to those skilled in the art in the light of the foregoing disclosure. By way of example, and not of limitation, the sheaves 22 and 23 can be replaced by sheaves of large diameter, as suggested by Fundom, No. 2,772,881, or by four pulleys, centered transversely between the side and center rails, to permit the belt to extend down and under the center of the treadles or to be split and fastened at two ends to the leading and trailing edges of the treadles. A pulley or sheave and belt arrangement is preferred because of its simplicity, but a mechanical interconnected lever or slide arrangement could be used. The frame bed can be made of tubing or the upright of angle iron, or the entire frame of wood, for example. The rollers and races can be of any desired sort, as for example, roller bearing-equipped wheels and flat surfaces. The pulleys can be constituted by rings of glass or slick-surfaced plastic, although it is desirable to keep the friction of the cable through the pulleys of whatever nature as low as possible, so that the counter forces are substantially all produced by the members being exercised, not the mechanical resistance of the machine. If a different ratio of movement and force between arms and legs is desired, the cables can be attached directly, after they leave the frame pulley, to the treadles, giving a one to one ratio, or, with that arrangement, the cables can be secured at one end to the upright and each of the hand stations provided with a pulley to permit a two to one ratio of hand force and movement to foot force and movement. Other ratios can be provided by using other combinations of pulleys. Various attachments, such as boots attached to the treadles or ski poles hinged to the frame and connected to the hand-grip cables, or a fold-up bench, can be provided, and the upright can be hinged and held securely in its upright position with a releasable brace or other holding means to permit easy folding of the upright over the bed for storage of the machine. The front or back of the bed can be elevated with respect to the other end, in which case the effect on the members when all four are being used in the standard way as shown in FIG. 4 is negligible, but when only two are being used, is augmented in one direction and diminished in the other by the force of gravity. This is not a preferred arrangement, for the reasons discussed above, but illustrates the versatility of the device. Electronic monitoring devices for counting movements or for monitoring the pulse of the user can be provided. These variations are merely illustrative.

I claim:

1. An resistance exercise machine wherein member is pitted against member, said machine comprising a frame including a horizontal reach and an upright, and four interconnected but separate movable stations, two mounted on said horizontal reach to accommodate the feet of the user and adapted to be stood upon and two, carried above said horizontal reach by said upright, to accommodate the hands of the user; a first, two-ended, elongated flexible means connected at one end to one hand station, passing through means supported by said upright for changing the direction in which said flexible means tends and connected at its other end to one foot station for transmitting force to move said foot and hand stations in opposite directions in response to the exertion by the user of a preponderant force on one of said hand and foot stations; a second, two-ended, elongated flexible means connected at one end to the other of said hand stations, passing through means supported by said upright for changing the direction in which said flexible means tends and connected at its other end to the other of said foot stations for transmitting force to move said foot and hand stations in opposite directions in response to the exertion by the user of a preponderant force on one of said hand and foot stations, and third means interconnecting said separate foot stations for transmitting force to move said stations in opposite directions in response to the exertion by the user of a preponderant force on one of said foot stations, said hand stations being interconnected mediately and only through said third means.

2. The improvement of claim 1 including a fixed frame with a bed and an upright, and upright pulleys swivelly mounted on said upright, each of said first and second cables extending in a single reach through one of said pulleys.

3. The improvement of claim 2 wherein frame pulleys are connected to the frame below the said upright pulleys, and a foot station pulley is connected to each of the foot stations, each of said cables extending through one of said frame pulleys, thence through one of said foot station pulleys, thence to the frame in the direction of the corresponding one of said frame pulleys where it is anchored at its free end, whereby force exerted by the user on the hand stations is substantially doubled on the foot stations and the travel of said foot stations relative to the travel of the hand stations is halved.

4. The improvement of claim 1 wherein the means for moving the foot stations comprises a belt having two spaced long reaches and at least two sheaves at opposite ends of said frame, said belt extending about said sheaves, and each of said foot stations being connected to said belt intermediate one of said long reaches.

5. The improvement of claim 1 wherein said foot stations comprise treadles mounted on rollers and said horizontal reach is provided with ways for said rollers and guides for guiding said treadles.

* * * * *